US008161661B2

(12) United States Patent
Bartol

(10) Patent No.: US 8,161,661 B2
(45) Date of Patent: Apr. 24, 2012

(54) CONTINUOUS DRYING APPARATUS AND METHOD

(75) Inventor: Julio R. Bartol, Montevideo (UY)

(73) Assignee: Active Land International Corporation, Panama (PA)

( * ) Notice: Subject to any disclaimer, the term of this patent is extended or adjusted under 35 U.S.C. 154(b) by 911 days.

(21) Appl. No.: 12/198,627

(22) Filed: Aug. 26, 2008

(65) Prior Publication Data

US 2009/0211110 A1 Aug. 27, 2009

Related U.S. Application Data

(60) Provisional application No. 61/031,596, filed on Feb. 26, 2008, provisional application No. 61/073,159, filed on Jun. 17, 2008.

(51) Int. Cl.
*F26B 21/06* (2006.01)

(52) U.S. Cl. ..... 34/86; 34/239; 48/197 R; 48/128; 110/235; 210/771; 432/3

(58) Field of Classification Search ..... 34/82, 86, 34/90, 2, 10, 239, 50, 5, 526, 242; 48/197 R, 48/128; 110/235; 210/771; 432/3
See application file for complete search history.

(56) References Cited

U.S. PATENT DOCUMENTS

| | | | | |
|---|---|---|---|---|
| 3,751,824 | A | 8/1973 | Kyle | |
| 4,207,056 | A | 6/1980 | Bowley | |
| 4,280,415 | A | 7/1981 | Wirguin et al. | |
| 4,633,849 | A | 1/1987 | Knox | |
| 5,069,801 | A * | 12/1991 | Girovich | 210/770 |
| 5,293,696 | A * | 3/1994 | Schmidt et al. | 34/76 |
| 5,474,686 | A * | 12/1995 | Barr | 210/771 |
| 5,588,222 | A * | 12/1996 | Thompson | 34/379 |
| 5,966,838 | A * | 10/1999 | Krebs et al. | 34/479 |

FOREIGN PATENT DOCUMENTS

| | | | |
|---|---|---|---|
| JP | 54117394 A | * | 9/1979 |
| UY | 28995 | | 8/2005 |
| UY | 28996 | | 8/2005 |
| WO | WO 9747933 A1 | * | 12/1997 |

* cited by examiner

*Primary Examiner* — Stephen M. Gravini
(74) *Attorney, Agent, or Firm* — Sughrue Mion, PLLC

(57) ABSTRACT

Provided are a continuous drying apparatus and method. The apparatus includes a combustion chamber, a heat exchange chamber, a filter, a mixing chamber, and a drying chamber. Biomass to be dried is loaded into an upper end of the drying chamber and falls on a rotating plate at a bottom of the drying chamber. Heated gas from the combustion chamber is mixed with recycled gas output from the drying chamber, and with recycled gas output from the heat exchange chamber, is filtered and is directed to the mixing chamber. Gas circulates within the mixing chamber and is directed into a lower end of the drying chamber at a drying temperature. The biomass loaded into the drying chamber is dried by the gas, and is extracted off the rotating plate.

8 Claims, 8 Drawing Sheets

CONTINUOUS DRYING APPARATUS AND METHOD

CROSS-REFERENCE TO RELATED PATENT APPLICATIONS

This Application claims the benefit of prior U.S. Provisional Application 61/031,596, filed in the United States Patent and Trademark Office on Feb. 26, 2008, and of U.S. Provisional Application 61/073,159, filed in the United States Patent and Trademark Office on Jun. 17, 2008, the entire disclosures of which are incorporated herein by reference.

BACKGROUND OF THE INVENTION

1. Field of the Invention

Apparatuses and methods consistent with the present invention are related to an energy- and time-efficient apparatus and method for drying material such as biomass, for example, firewood, split logs, and other wood mass.

2. Description of the Related Art

Many moist solid products need to be dried in an efficient way before they can be used and/or marketed. This is the case with grains and other agricultural products such as wood. Firewood and wood products dried to moisture contents below 15%, represent a unique source of high quality renewable energy with flame temperatures that exceed those of some fossil fuels.

The burning of wood is currently the largest use of energy derived from a solid fuel biomass. Wood fuel can be used for cooking and heating and for fueling steam engines and steam turbines that generate electricity, as well as a myriad of other applications.

Firewood also has a number of potential uses in renewable energy technologies including as wood pellets, in efficient stoves for developing nations, and as sawdust, which can be pelletized and or used as hog fuel.

Potentially the most important step in preparing wood for use is drying. There is about 80 percent more heat value in properly dried wood (having a moisture content below about 20% ) than in freshly cut wood (having a moisture content above about 50% ) due to the lower moisture content. Broadly, there are two methods for drying timber, natural drying (or air drying) and artificial drying.

Air drying is the drying of timber by exposing it to the air. This is a simple technique generally involving putting the wood in a clean, cool, dry, and shady place, and stacking the wood to be dried such that air can properly circulate through the stack. Generally it is considered best to use wood with less than about 30% moisture content that has air dried for at least six months.

Furnace or kiln drying is a process of introducing heat to speed up the drying process.

A furnace structure may include a main body including a truncated cone or similar with a firewood charging chute at the top and guides towards the interior of the main body, as for example chain curtains hanging from a rim of an entrance opening or an inverted truncated cone to guide the wood radially outward. The main body may also be equipped with openings at the top for escaping air and moisture.

A rotary plate may be used within the main body, centered on a vertical axis of the main body. Firewood that enters the main body by the charging chute lands on this plate after its downward transit through the furnace. This plate may have pins or manual or mechanical pushers on its upper face to help the motion and circulation of the firewood. A plate having a spiral shape may also be used to help move firewood within the main body and to guide properly dried wood to an exit, where it is expelled towards a bin or conveyor belt. Additionally, other mechanical means may be used to guide dried wood to an exit of the main body.

As is described in two previous Applications of the present inventor (Uruguay Application Nos. 28,996 and 28,995, both filed on Jun. 30, 2005), the high temperature of byproduct heated chimney gas may be taken advantage of and used in the drying process.

SUMMARY OF THE INVENTION

A continuous drying apparatus according to an exemplary embodiment of the invention includes a drying chamber, comprising a chute, disposed at an upper end thereof, through which biomass is loadable; a plate forming a bottom surface thereof; and an extraction unit in a lower end of a peripheral wall thereof; and a combustion chamber which generates hot gas. One or more filters (e.g. water filters or cyclones), which filter recycled gasses, may be used to filter the gas before it enters the drying chamber. The apparatus also includes a heat exchange chamber which exchanges heat between gas, at a first temperature, from the combustion chamber, and recycled gas, at a second temperature, lower than the first temperature; a mixing chamber which receives one or more of gas recycled from the drying chamber, exhaust gas from the combustion chamber, gas from the heat exchange chamber, and gas from the one or more filters. At least one fan may be used which directs gas to the mixing chamber and into a lower end of the drying chamber such that gas from the mixing chamber rises within the drying chamber in a direction against a falling direction of biomass from the chute. Such gas may be partially exhausted to the atmosphere, via an exhaust fan, to eliminate part of the water vapor generated inside the drying chamber. Alternately, rather than being vented to the atmosphere, this gas may be directed, through a sleeve (of canvas or another suitable material) to a storage bin. The sleeve may surround a conveyor belt which directs moist charge material form the storage bin to an upper portion of the drying chamber. The storage bin may be used to preheat the moist charge. Preheating makes use of all the available energy contained in the exhaust gas from the drying chamber. The remaining portion of the gas may be recycled to the system.

A continuous drying method according to an exemplary embodiment of the present invention includes providing gas at a drying temperature and biomass to be dried to a drying chamber, drying the biomass within the drying chamber, and extracting dried biomass from the drying chamber. Gas is heated in a combustion chamber to a heated temperature above the drying temperature. Heated gas from the combustion chamber is used to heat recycled gas from the drying chamber, and gas at the drying temperature is output to the drying chamber. The gas at the drying temperature is provided to a lower end of the drying chamber, as biomass is continuously loaded into an upper end of the drying chamber in order to fill the drying chamber and maintain that level as dry biomass is extracted at the bottom of the drying chamber, such that the biomass moves in a downwards direction within the drying chamber against a rising flow of the gas, and lands on a lower surface of the drying chamber. The lower surface of the drying chamber is rotated, and dried biomass is extracted from a periphery of the lower surface.

BRIEF DESCRIPTION OF THE DRAWINGS

The above and exemplary aspects of the present invention will become more apparent by the following detailed description of exemplary embodiments thereof with reference to the attached drawings in which.

Illustrations included in the Figures are not necessarily to scale, but are illustrated for purposes of the clear understanding of those of skill in the art.

DETAILED DESCRIPTION OF EXEMPLARY EMBODIMENTS OF THE INVENTION

Hereinafter, exemplary embodiments of the present invention will be described more fully with reference to the accompanying drawings.

Exemplary methods of use of drying apparatuses of the present invention are characterized by a unique and highly efficient "maximum temperature/minimum time" drying cycle. Methods and apparatuses of exemplary embodiments of the present invention are characterized in that there is very little oxygen entering the drying chamber in those embodiments in which there is recirculation of gasses from the combustion chamber which contain carbon dioxide. This enables the material to be dried more quickly at a high heat, while simultaneously reducing fuel consumption and fire hazards.

Figure 1A:
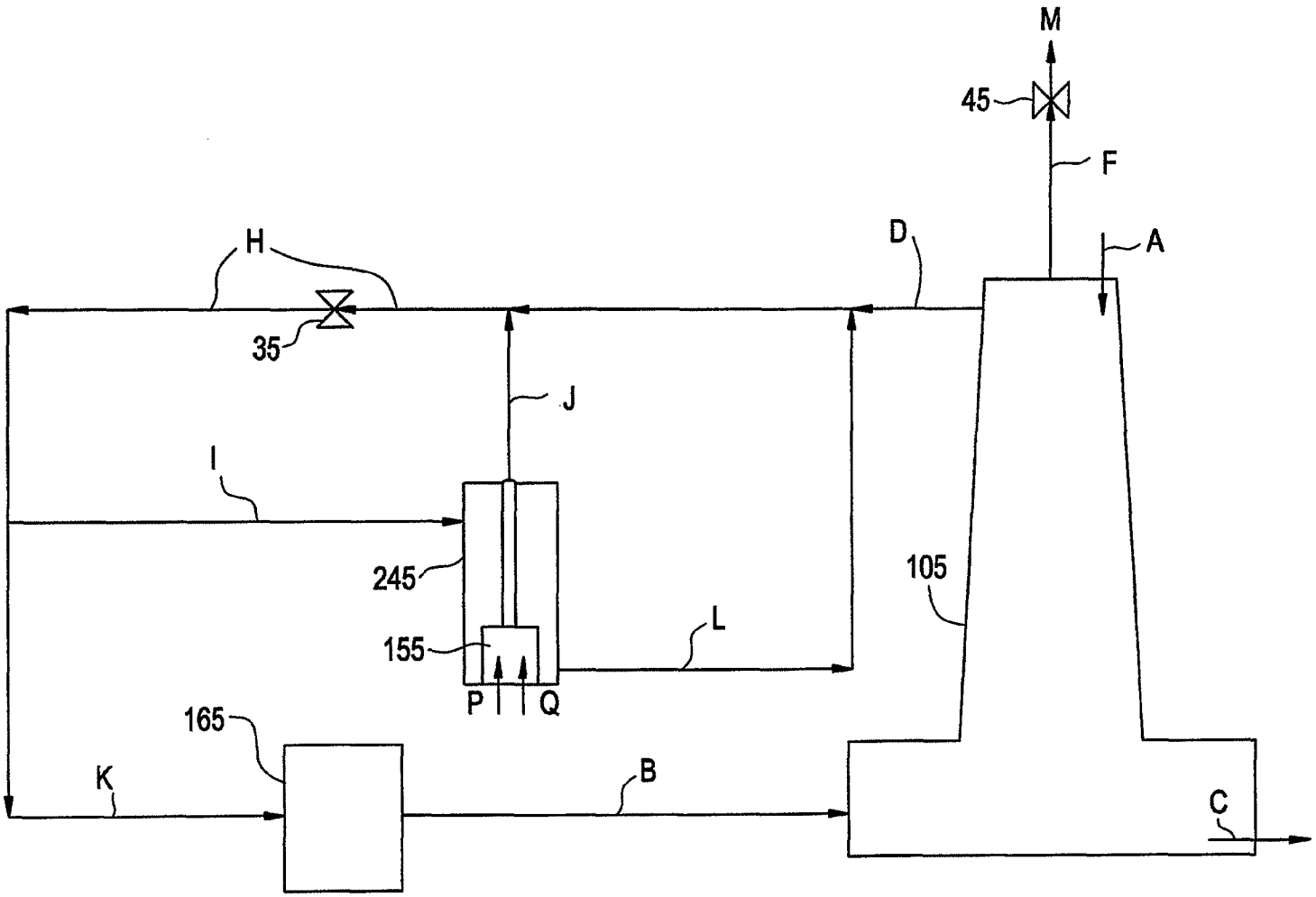
FIGS. 1A and 1B illustrate the flow of gasses and material among and between elements of exemplary drying apparatuses of the present invention, as well as exemplary apparatuses and elements.
Figure 1B:
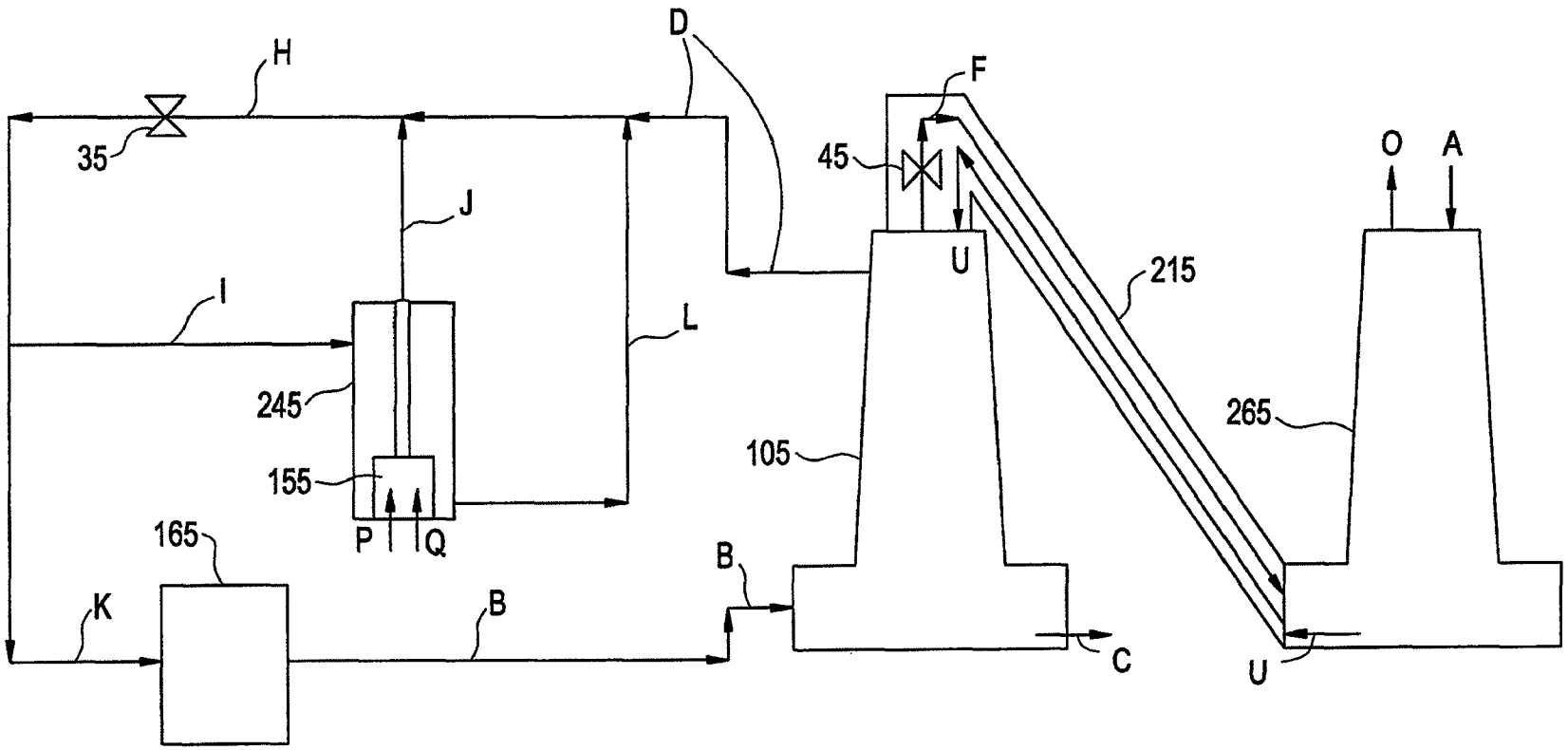

FIGS. 1A and 1B are flow charts illustrating the flow of gasses and material among and between various elements of exemplary embodiments of the present invention. The exemplary embodiments illustrated in FIGS. 1A and 1B are designed to dry moist materials which are generally not combustible, such as some mineral concentrates, for example, and which are not affected by particles (e.g. burning particles from the combustion chamber with temperatures that may reach about 500° C. (about 752° F.) and/or unburned particles or ashes) carried by drying gasses which may contaminate the moist material. In addition, these embodiments may be used with charge materials whose taste and smell are not adversely affected by the drying gas, or for which the taste and smell are not relevant. Of course, these exemplary embodiments may also be used with other charge material, with or without modifications which would be understood by one of skill in the art.

The features and elements of FIGS. 1A and 1B include a drying chamber 105, a combustion chamber 155, a heat exchange chamber 245, and a mixing chamber 165, along with various fans, blowers, conveyors, plenums, and other accessories, as discussed herein and as would be understood by those of skill in the art. One or more fans 35 take recycled gas J from the combustion chamber, recycled gas D from the drying chamber 105, and recycled gas L from the heat exchange chamber 245, and combines them in to obtain gas H at a drying temperature. A fraction I of the gas H at the drying temperature is recycled to the heat exchange chamber 245 to cool down exposed surfaces of the combustion chamber and its chimney. The remaining portion K of gas H is directed to the mixing chamber 165 and into the drying chamber 105 as gas B. Drying gas B is input into a lower end of the drying chamber 105 and rises against the descending mass of moist material. Gas B eventually exits the drying chamber 105, as recycled gas D and exhaust gas F, carrying with it a portion of the evaporated water, thus balancing the mass input of air into the drying chamber 105.

In FIG. 1B, a preheating chamber 265 is incorporated to increase the drying efficiency inside the drying chamber by making full use of the energy contained in gas F from the drying chamber 105.

Figure 2A:
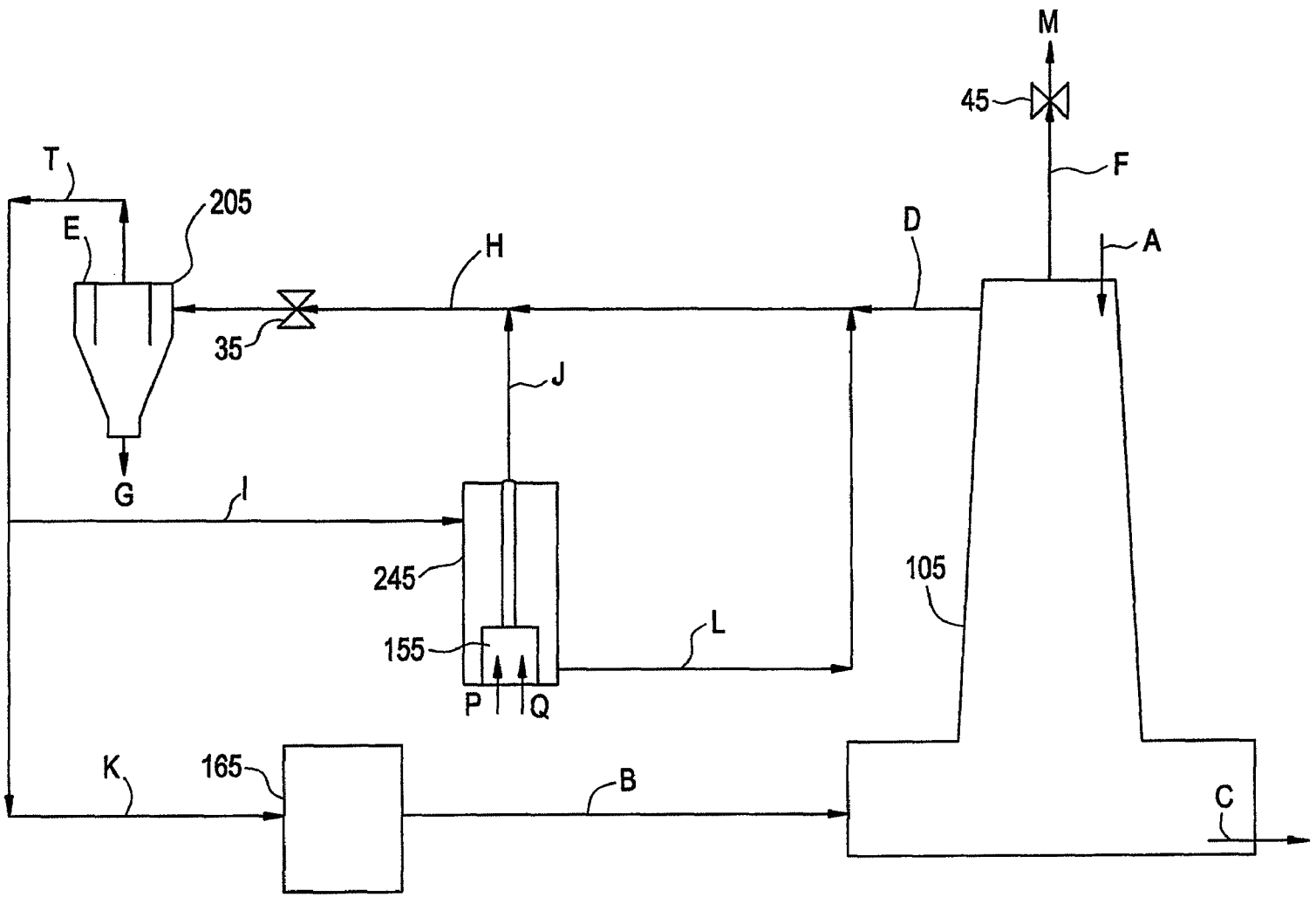
FIGS. 2A and 2B illustrate the flow of gasses and material among and between elements of further exemplary drying apparatuses of the present invention, as well as exemplary apparatuses and elements.
Figure 2B:
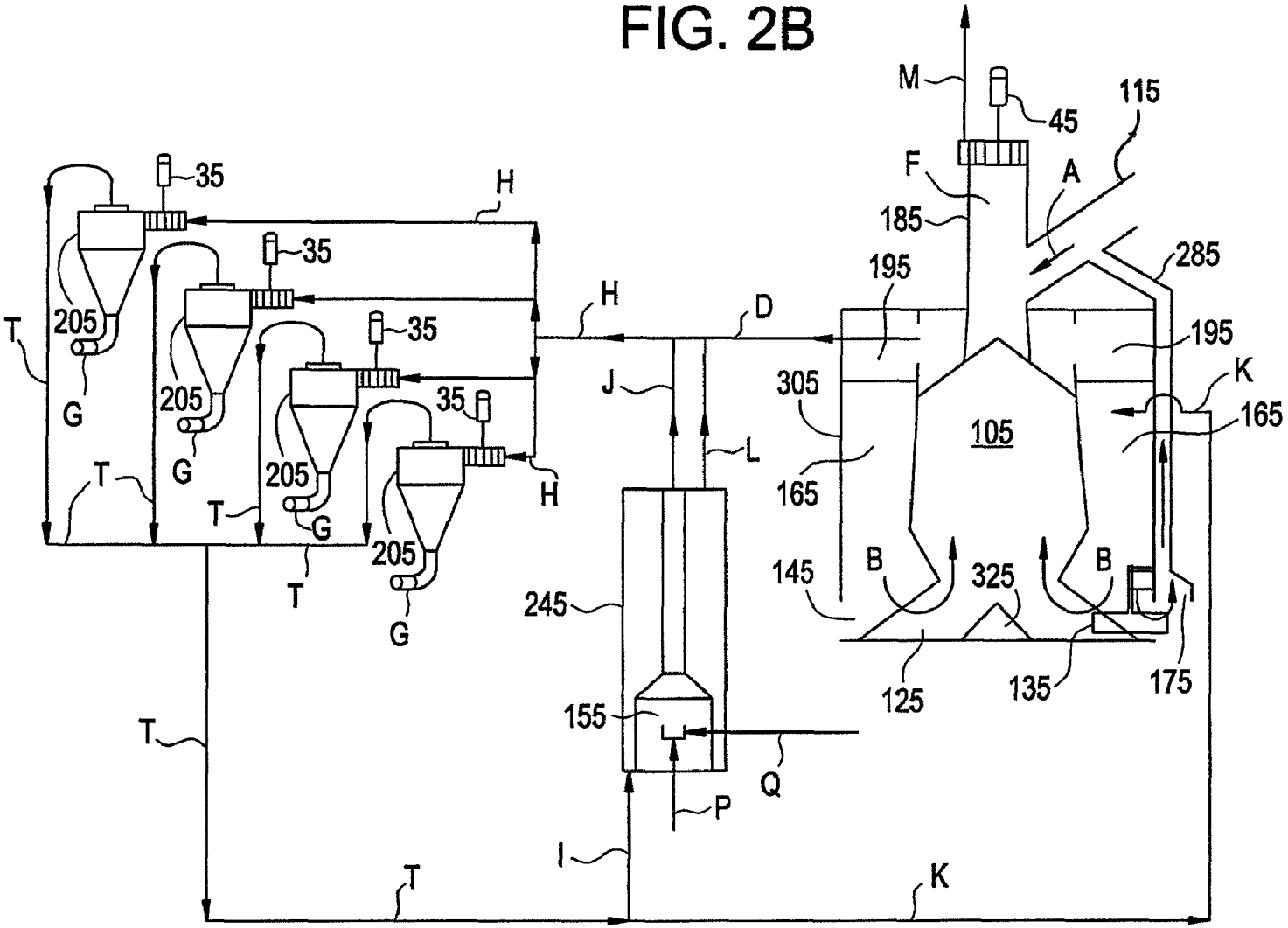

FIGS. 2A and 2B illustrate the flow of gasses and material among and between various elements of another exemplary embodiment of the present invention. The exemplary embodiments illustrated in FIGS. 2A and 2B are designed to dry moist materials with low ignition temperatures (below about 200° C. or about 329° F.), such as wood products or other biomass used as fuel, which have a lower tolerance for hot particles than other materials, but which can tolerate contamination by unburned particles, ashes, odors, or taste. Of course, these exemplary embodiments may also be used with other charge material, with or without modifications which would be understood by one of skill in the art.

Gas H at a drying temperature passes through one or more filters 205 in order to eliminate burning particles that recycled combustion gas J may carry and which may create a fire hazard inside the drying chamber 105. Clean gas T at a drying temperature is divided into gas I and K as in previous FIGS. 1A and 1B. Only clean gas B at a drying temperature enters the drying chamber 105. FIG. 2B shows an arrangement in which a number of the elements are housed inside a surrounding rectangular shell 305. A combustion chamber 155 with a chimney is housed inside a heat exchange chamber 245. Multiple fans 35, may be disposed at an upper part of a plenum 195, and the multiple filters 205 may be housed inside the plenum 195 that surrounds and is connected to drying chamber 105. The filters 205 may be water filters, cyclone filters, or other filters as would be understood by one of skill in the art. A hood and chimney 285 may be located over a discharge port 175 to capture and recycle, into a loading chute 115, any portion of gas B that may be exhausted through the discharge port 175.

Figure 5A:
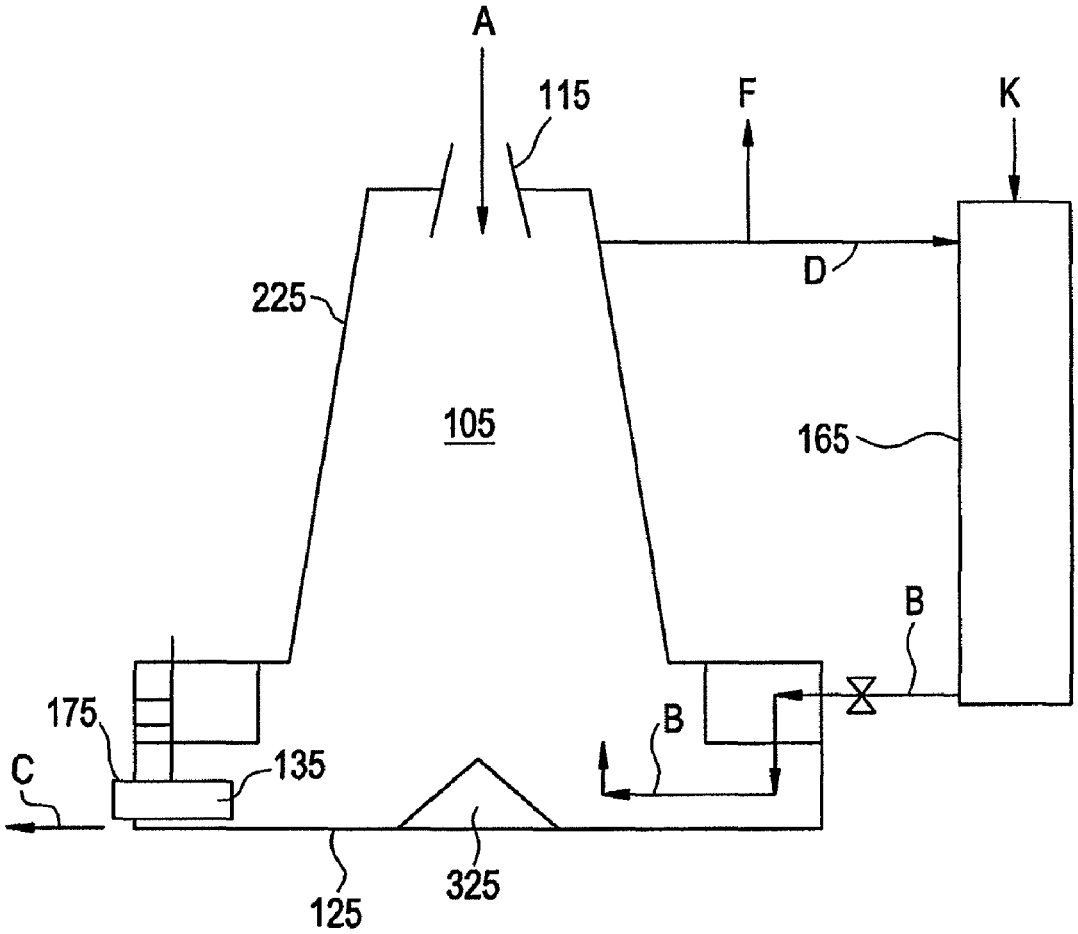
FIGS. 5A and 5B illustrate additional exemplary drying chambers and mixing chambers according to embodiments of the present invention.
Figure 5B:
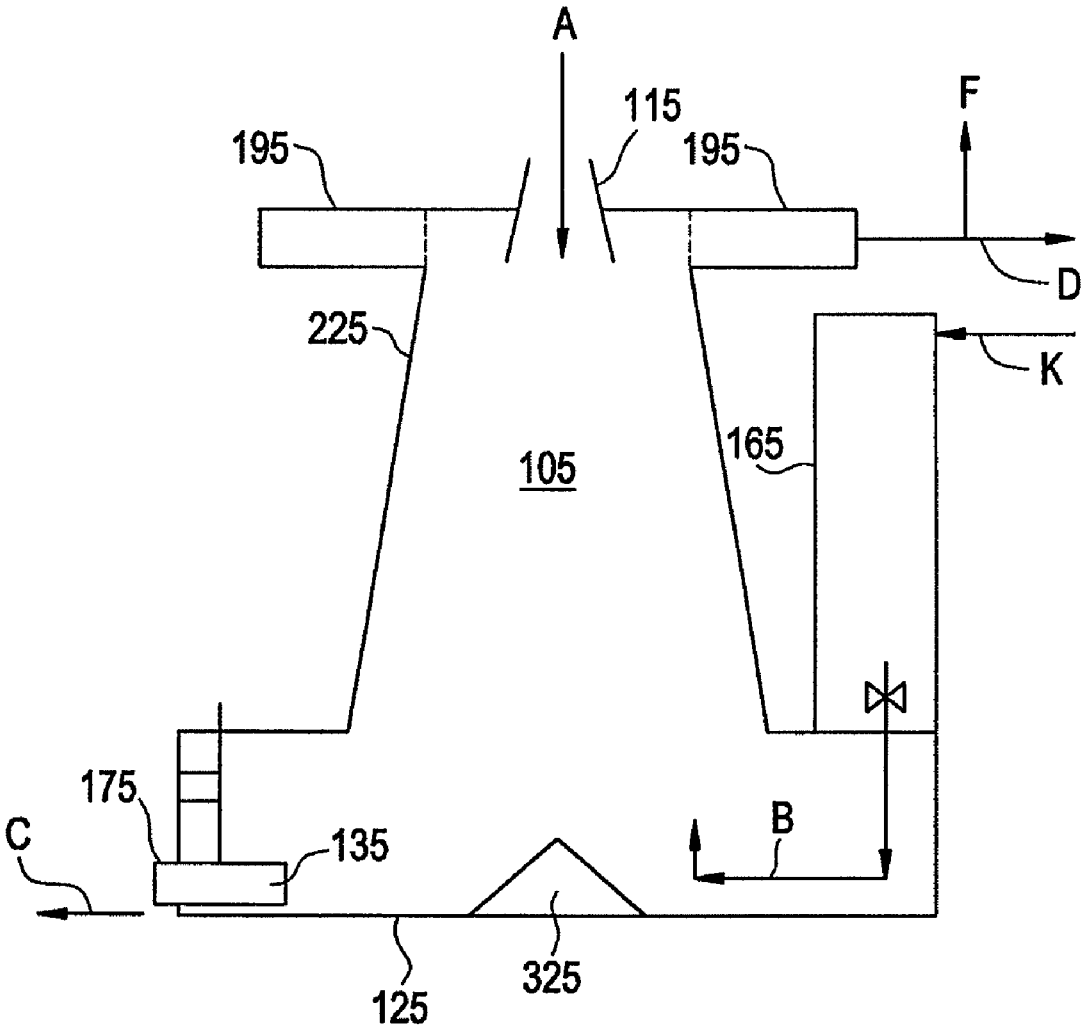

Exemplary drying chambers are illustrated in FIGS. 2A and 2B, as well as FIGS. 5A and 5B. The drying chamber 105 is substantially vertical, and has a distributing rotating plate 125 disposed at a bottom thereof. A distributing cone 325, or similar, may be disposed on an upper face of the rotating plate 125. The drying chamber may be made out of steel plate or other suitable material which may have the shape of a truncated cone with its wider base at the bottom.

FIG. 2B illustrates how moist charge material A, fed into an upper opening of the drying chamber 105 through a chute 115, moves downward countercurrent to a flow of hot gasses B from below. This may be a continuous process, and the discharge of material A into the drying chamber 105 may be controlled based on a desired moisture content of the finished product by varying a plate rotation speed and/or a drying temperature of the hot gasses B. The material moves downward within the drying chamber 105 and lands on a rotating plate 125 at the bottom of the drying chamber 105, forming an angle of repose which is determined by the specific material charged. A pile of material to be dried thus forms inside the drying chamber 105 resting on the rotating horizontal plate 125. The cone 325, or similar, disposed on an upper surface of the plate 125 helps the movement of the material outwards.

Figure 3:
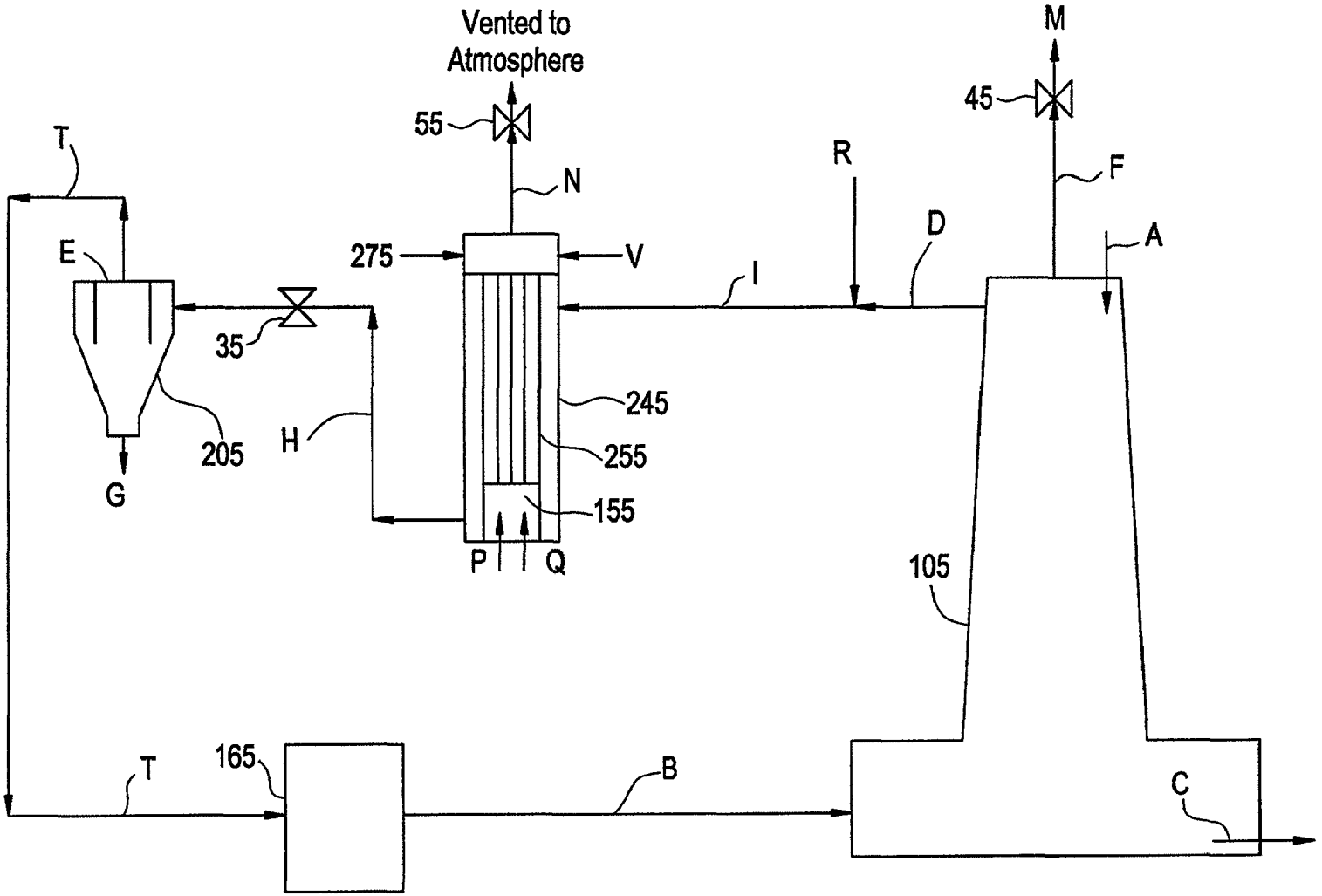
FIG. 3 illustrates the flow of gasses and material among and between elements of another exemplary drying apparatus of the present invention, as well as exemplary apparatuses and elements.

FIG. 3 illustrates the flow of material according to an exemplary embodiment of the present invention. Exemplary apparatuses and methods of this embodiment are designed to dry moist materials with ignition temperatures below about 200° C. (about 392° F.) and which generally cannot tolerate contamination by hot and/or unburned particles, ashes, odor, or taste, or other contaminants. Of course, these exemplary apparatuses and methods may also be used with other charge material, with or without modifications which would be understood by one of skill in the art.

In this embodiment, all combustion gasses are removed from the circuit as exhaust gas N. Recycled gas D from the drying chamber 105 is combined with input air R and directed to the heat exchange chamber 245 where a heat exchanger 255 transfers heat from the combustion gasses to gas I until it reaches a drying temperature. The heated gas then exits the heat exchanger 255 as gas H. Clean gas T, at a drying temperature, is directed to the mixing chamber 165, and drying gas B is directed to the drying chamber 105 to dry the descending charge of moist material. The heat exchanger 255 may be designed to produce a required amount of clean hot gasses T at a specified drying temperature, in order to dry the amount of moist material A to the output material C having a desired level of moisture content.

As shown in FIG. 2B, the drying chamber 105 has a discharge port 175 at the bottom, for discharging the dried material C, and one or more inspection doors 145 to enable an operator to charge moist material on top of plate 125 mechanically or by hand before starting up the drying process. The initial charging of moist material A on top of the plate 125 may be done manually or mechanically up to a height of approximately 50 cm (about 20 inches) in order to cushion the fall of moist charge A subsequently input through a chute 105. After the initial charging of the material on the plate 125, a rotation of the Plate 125 is started and the moist charge material may be automatically input into the chute 115 at an upper end of the drying chamber 105 via an elevated mechanism, such as a conveyor belt. This may continue until the drying chamber 105 is about seventy five percent full. Upon reaching this charge level, all equipment related to the generation and conditioning of gasses may be started. The combustion chamber is loaded with fuel and sufficient air is made available to start up the combustion process to generate hot gasses J which are recycled to the filter 205. Dried material C starts to be discharged through the port 175 in a continuous manner and may be kept on hold until the desired moisture content of dried material C is attained. Material kept on hold may be then recycled into the drying chamber.

Figure 4:
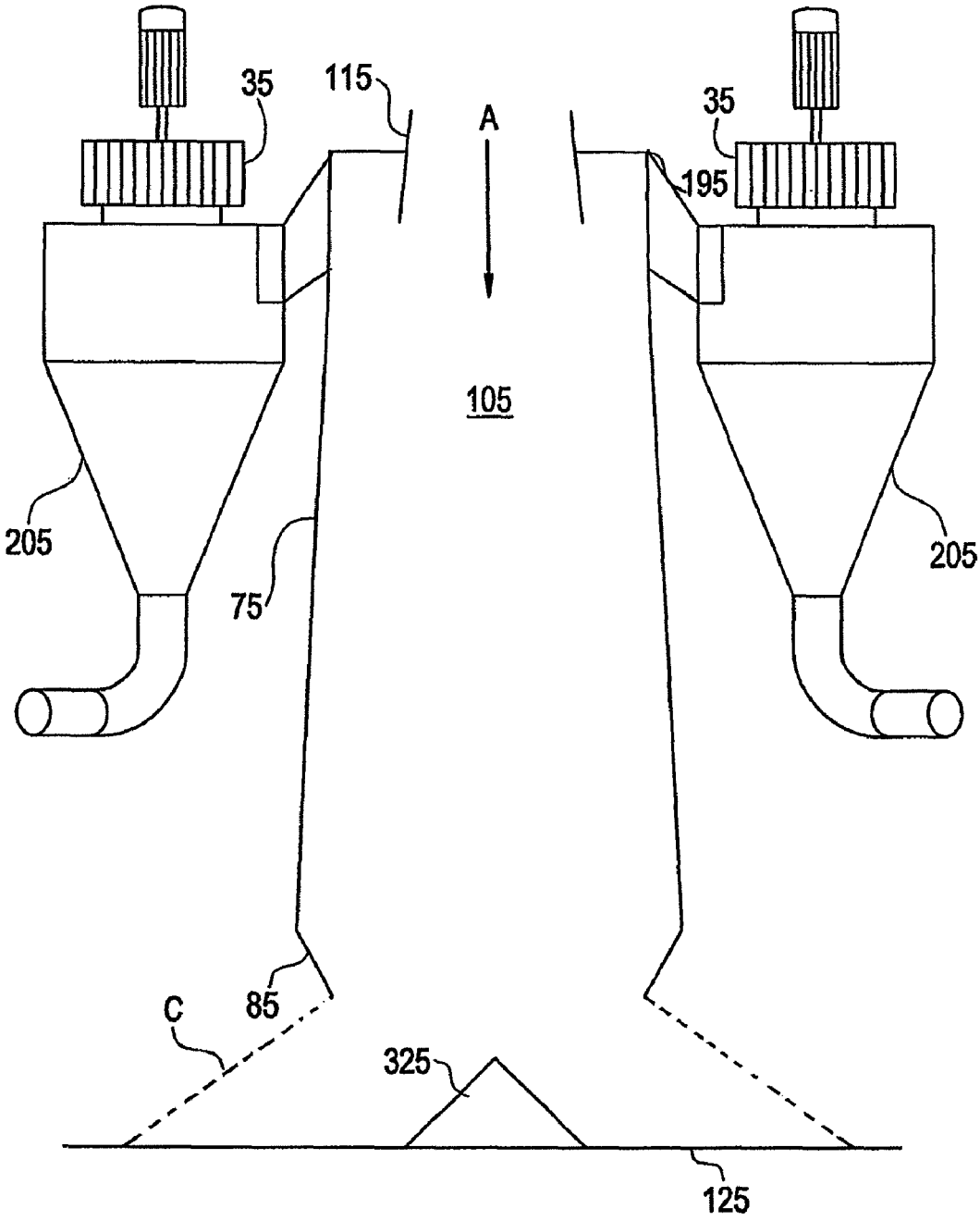
FIG. 4 illustrates an exemplary apparatus having a compact design according to an exemplary embodiment of the present invention.

FIG. 4 illustrates an apparatus with a drying capacity of approximately 26 cubic meters (about 918 cubic feet). The design of this apparatus depends on the angle of repose and the size of the moist charge material A and dried material C. These elements are used to determine the dimensions of the drying chamber 105; its distance from the plate 125; and the diameters, angles, and height of the large truncated cone 75, of an optional small inverted truncated cone 85, and of the cone 325 or similar that may be placed on top of plate 125 to move the dried material C towards the periphery of the plate. The optional small inverted truncated cone 85 may be integrally formed with walls of the drying chamber 105. According to an exemplary embodiment, the drying apparatus is designed to dry split logs approximately 0.50 meters long (about 19.7 inches), originally having a maximum diameter of about 0.25 meters (about 9.8 inches). According to such an embodiment, the angle of repose of the split logs is approximately 37°. To ensure a smooth flow of material, a distance between lower edges of the drying chamber 105 and the rotating plate 125 may be at least twice the length of the split wood, or about one meter (about 39.4 inches). Also, the angle of the large truncated cone 75 may be smaller than about 90°, or approximately 87°, according to this example. To avoid using a very large diameter plate, a second inverted truncated cone may be positioned to reduce the diameter of the circle occupied by the material C, and its angle may be greater than the angle of repose of the material, or approximately 60°. In addition, the diameter of discharge of the small inverted truncated cone may be at least four times the length of the dried material or about 2 meters (about 78.7 inches). The dimensions of the drying chamber can then be determined based on a required drying cycle, and any limitations of maximum width and height of the drying chamber 105 and the maximum diameter of the rotary plate 125. The cone 325, or similar, on the rotary plate 125 may have a base greater than the approximately one meter (about 39.4 inches) radius of the lower truncated cone, or about 1.20 meters (about 47.2 inches), and may have an angle greater than the angle of repose of the dried material C, or about 45°, in order to facilitate the movement of dried material C towards the periphery of the plate 125 so that an extractor/sweeper 135 can operate efficiently. The plate 125 is rotatable by a motor (not shown), and the rotary motion of the plate 125 and a mechanical extractor 135 destabilize the angle of repose, such that dried material C at the lower periphery of the drying chamber 105 can be extracted through a discharge port 175.

The lower circumferential sides of enclosure shell 305 or the chamber 105 may comprise one or more hanging standard welded carbon steel plates or other hanging material as would be understood by one of skill in the art. A discharge opening 175 may be cut or positioned in the steel plates and can be made large enough that dried material can be easily extracted therethrough. One or more inspection doors 145 may be installed in the lower part of the enclosure shell 305 to enable an operator to inspect a condition of the discharge and to load moist charge C onto the plate 125, mechanically or by hand, to cushion the fall of moist charge A during start up of a drying production.

The drying chamber, including walls 225, plate 125, cone 325, and extractor/sweeper 135 may also function as a controlled-discharge storage bin. Such a discharge bin can also be used as a preheating chamber 265 for moist charge A, as shown in FIG. 1B, in conjunction with a loading conveyor belt or other mechanism (not shown) that feeds charge material into the drying chamber loading chute 115. Exhaust gas F leaving the drying chamber 105, can be directed into a canvass or similar sleeve 215, surrounding the loading chute 115 and the charging conveyor belt (not shown), into the controlled storage bin 265 where the moist material A is charged. These gasses are saturated with water vapor and will condense water upon contact with the cold moist charge A inside the storage bin. The heat given up by the water vapor as it condenses, will warm up the moist charge A and will make the drying process inside the drying chamber 105 more efficient as shown, for example, in Table 1.

Exemplary apparatuses and methods of the present invention are directed to drying moist charge material such as, but not limited to mineral concentrates, biomass (such as logs, split wood, wood with bark, wood that has been debarked, wood chips, sawdust, and other wood materials, and grains), and other material as would be understood by one of skill in the art. The material may be large, such as logs having diameters of up to about 10 inches and lengths of up to about 20 inches, or may be very small, such as sawdust, grains, and the like.

Moist charge material A to be dried is loaded into the drying chamber 105 via a loading chute 115. The material moves downward within the drying chamber 105 and lands on the rotating plate 125 at the bottom of the drying chamber 105. The cone 325, or similar, may be disposed on an upper face of the plate 125, as discussed above.

The moist charge material A may be loaded into the chute 115 via a conveyor belt or other mechanical means, as would be understood by one of skill in the art.

The enclosed and elongated chute 115, as well as other exemplary features discussed hereinbelow, helps to minimize air infiltrations into the drying chamber 105. The less ambient air that enters the drying chamber 105, the less oxygen is entering the chamber. This permits the material to be dried in a shorter period of time at a higher temperature, because the fire hazard is reduced.

The chute 115 may have a diameter which increases with depth into the drying chamber 105 in order to prevent blockages of the descending moist charge material A. A piece of canvas or other suitable material may be used to cover an upper opening of the chute 115 when it is not being filled, to further prevent air infiltrations. The cover may be pushed out of the way when charge material A is being loaded into the drying chamber 105. The chute 115 may be substantially vertical, or may be at an incline.

The depth of the chute 115 into the drying chamber 105 can be determined or modified in accordance with the material to be dried. For example, smaller material which requires less time within the drying chamber 105 may be used with a chute that extends farther into the drying chamber 105. The longer chute will further prevent air infiltration into the drying chamber, and, because the smaller material is extracted more quickly from the drying chamber 105, the chute can be extended without a risk of its lower end being blocked by a build-up of material. Alternately, if only smaller material is to be dried, the overall height of the drying chamber may be modified and shortened to provide the material with less time in the drying chamber 105.

A volume of material in the chute 115 creates a certain amount of obstruction, further minimizing air infiltration into the drying chamber 105 through the chute 115.

Heated gasses B are input into the drying chamber 105 from the mixing chamber 165, as discussed in further detail below.

Gas is output through an upper portion of the drying chamber 105 into an exit plenum 195, and from the exit plenum 195. A fraction of the gasses output from the drying chamber are removed to the atmosphere as exhaust F through the chimney/exhaust 185 or to preheat moist charge A in preheating chamber 265 as indicated in FIG. 1B. The remaining gasses D from the drying chamber 105 are re-circulated by one or more fans 35, discussed below, to one ore more filters 205 (FIGS. 2A, 2B and 3) or directly to the mixing chamber (FIGS. 1A and 1B). Inner walls of the exit plenum 195 may be made of standard welded carbon steel sheet. Outer, upper, and lower walls of an exit plenum 195, as well as walls of the mixing chamber 165 and drying chamber 105 may be made of standard welded carbon steel sheet at a thickness of ⅛ inch, for example.

The portion of gas F from the drying chamber vented to the atmosphere may be proportionate to an amount of air input into the combustion chamber 155 required to generate sufficient hot gasses to reach drying temperature of gas B. This maintains a balance between the mass input with the mass output of the system.

Dried material C is output from the drying chamber 105 via an exit 175. A rotating extractor/sweeper 135 may be positioned at the exit 175 to facilitate the movement of dried material C out of the drying chamber 105. The extractor/sweeper 135 may comprise a simple arm rotating substantially horizontally which sweeps dried material C off the plate 125. The extractor/sweeper 135 may be controlled by a motor (not shown). A speed of rotation of the extractor/sweeper 135 and a speed of rotation of the plate 125 may be controlled to accommodate different drying times, and different desired output speeds.

According to an exemplary aspect of the invention, the extractor/sweeper 135 may comprise a carbon steel axle that hangs within the drying chamber 105 and is driven by a motor with variable speed (not shown) located above the extractor and outside the drying chamber to protect it from heat. The axle may be held vertically by two intermediate supports including ball bearings. The axle is surrounded by a steel tube that has a larger inner diameter than the axle. There may be a window in the drying chamber 105 that permits the axle to be cooled by a natural draft of cool air created by the temperature differential between the interior of the drying chamber 105 and the external air. The location and height of the axle is such that it permits the arms to sweep a circle that extends beyond the plate 125 to push and discharge the dried material C. The axle may be positioned so that the arms rotate approximately one inch over the top of the plate 125.

The horizontal extractor arms are made out of 3/16 inch steel plate and are each about 15 inches in overall length. They are welded at the bottom of the axle forming an angle of about 90° with the axle. The arms may also be adjustable. An exemplary total length of each of the arms may be about 20 inches so that the same extractor 135 may be used with different materials. The height of the extractor arms may be about 8 inches, but may be made higher as desired for various materials. The direction of rotation of the extractor/sweeper 135 is opposite that of the plate 125, so that the arms of the extractor/sweeper 135 can push dried material out of the drying chamber 105. Strips of rubber-backed canvas or another suitable material may be attached to lower sides of the arms in order to sweep small particles of material that remain on the plate 125 below the bottom edges of the arms.

The extractor/sweeper may be regulated by an electronic device (PLC) so that in case it encounters excessive resistance, it can be stopped and immediately reverse its direction of rotation for a period of about 2 seconds to help dislodge the cause of the stoppage. If it is stopped again, there may be an alarm to warn an operator of the problem so that it can be manually addressed.

The apparatuses and methods of the present invention may also include additional, exemplary instrumentation and control strategies including variable speed devices that control all motors to allow for fine adjustments of speed rotation of fans, conveyor belts (not shown) and the rotating plate 125. Gas flowmeters, pressure gauges, and on-line temperature of gasses at each stage of the process and relative humidity readings of gas F may be used to calculate the amount of evaporated water using phsychrometric tables and to maintain the process under control. The calculation to arrive at the amount of evaporated water may take into consideration the amount of water contained in the fuel and in the air used for combustion, as well as the amount of water formed during the combustion process. Fire alarms or an operator that detects flames inside the drying chamber 105 may trigger an immediate opening of valves to spray water on the plate 125, on the truncated cone 85, and surrounding the drying chamber loading chute 115.

Upon extraction from the drying chamber 105, the dried material C may be directed to a conveyor belt or the like.

One or more filters may be used in the circuit of gasses and material, in order to purify the gasses. These filters may be water filters or other filters, such as dry or wet cyclone filters, as would be understood in the art, to purify gasses, such as for the removal of small particles. For example, a filter 205 may be disposed in the circuit to purify gasses entering the mixing chamber 165. Other filters (water filters or other types) may be incorporated to purify the gasses at other locations in the circuit including, but not limited to, at the chimney to purify gasses being vented to the atmosphere.

The one or more filters 205 receive the recycled gas D from the drying chamber 105 and gas J from the combustion chamber 155 and may also receive recycled exhaust gas L from the heat exchange chamber 245. The one or more filters 205 filter the input gasses to remove burned or burning material, as well as particles of material, for example. Waste G is removed from the gasses by the one or more filters 205, and filtered, clean gas K (FIGS. 2A, 2B) or filtered, clean gas T (FIG. 3) is output to the mixing chamber 165 prior to entering the drying chamber 105.

One or more filters which remove 99% of particles above about 0.0045 mm (about 0.000177 inches) in diameter may be used, and this efficiency can insure that no incandescent material will leave the filter, thus further reducing a fire risk within the drying chamber 105.

The combustion chamber 155 may comprise a regular pollution-free fireplace. Alternately, for large drying installations, a one- or two-stage combustion chamber of the type used in steam boiler installations may be used. The gas that is generally a byproduct of a traditional steam boiler installation and is generally vented to the atmosphere may be recycled, as needed, to aid in the provision of gasses at a desired drying temperature.

The heat required in the process to evaporate one pound of water is very low and well below 1,800 BTUs. Therefore, the biomass that needs to be burned to generate this amount of heat varies with its moisture content (MC) but, in general, it is also very low. As an example, only about 0.350 lbs. of biomass with 30% MC or 0.275 lbs. of biomass with 15% MC is needed to evaporate 1 lb. of water.

As shown in FIG. 3, gas D from the drying chamber 105 and fresh air R is input into the heat exchanger 255 to bring output heated, gas H to a drying temperature of about 150° C. (about 302° F.).

The gasses J from the combustion chamber 155 may be at a high temperature of about 1200° C. (about 2192° F). Gasses J mix with recycled, cooler exhaust gas D from the drying chamber 105 in adequate proportions to reach a drying temperature of about 150° C. (about 302° F.) as gas H. In an exemplary embodiment in which no filter is used, a fraction I of gas H is recycled to heat exchange chamber 245 to cool down the chimney and exposed surfaces of the combustion chamber 155. In the process, the cooler gas I is heated and is output as recycled heated gas L to be mixed with gas D and reach a drying temperature as gas H. A fraction K of gas H is directed to the mixing chamber 165 before it enters the drying chamber 105 as drying gas B. According to an embodiment in which one or more filters 205 are used, gas H, at a drying temperature, enters the one or more filters 205 and emerges as clean gas T at a drying temperature. A fraction I of gas T is recycled through the heat exchange chamber 245 to cool down the chimney and exposed surfaces of combustion chamber 155. In the process, the cooler gas is heated and is output as heated gas L to be mixed with gas D creating gas H, at a drying temperature. A fraction K of gas H is directed to the mixing chamber 165 before it enters the drying chamber 105 as drying gas B.

The drying temperatures disclosed herein are exemplary, and the various temperatures of the gasses throughout the embodiments of the present invention may be determined as would be understood by one of skill in the art.

The combustion chamber 155 has a sufficient capacity to burn the amount of fuel required to generate the quantity and temperature of gasses for the drying process. It includes insulation, heat exchange plates, or the like in order to withstand temperatures of up to about 1700° C. (about 3092° F.), when burning very dry biomass. Exhaust gasses J from the chamber 155 may be mixed with the recycled exhaust gasses F or vented to the atmosphere separately from the chimney/exhaust 185 as gas N. The combustion chamber 155 may thus also include a separate fan 55 and may further include a separate filter, as would be understood by one of skill in the art, based on local environmental regulations.

Alternately, exhaust gasses J from the combustion chamber 155 may be recycled, via one or more fans 35, into the filter 205. The one or more fans 35, which direct a portion of gas H as cooling gas I to the heat exchanger chamber 245, creates a positive pressure in the heat exchange chamber 245 to reduce the possibility of escaping hot embers or sparks from the combustion chamber, thus reducing a fire hazard.

The heat exchanger 255 may be disposed above the combustion chamber 155 to allow hot gasses to easily pass into the heat exchanger 255. The heat exchanger 255 may include a series of parallel steel tubes (not shown) with fins attached thereto (e.g. by welding) to dissipate heat from the heated gasses J passing therethrough. The surrounding environment of the heat exchanger 255 may be enclosed in a heat exchange chamber 245 in which the cooler gasses D, at a temperature of about 80° C. (about 176° F.), for example, are mixed with additional air R (at room temperature), to balance the exhaust mass F, forming gas I before entering the heat exchange chamber 245. Gas I emerges as gasses H, at a drying temperature (for example, about 150° C. or about 272° F.). In this way, the exposed surfaces of the heat exchanger 255 and the combustion chamber 155 lose heat to the passing gasses I and can operate with a lower risk structural damage due to overheating. In this case, the heat exchange chamber 245 is under negative pressure but a risk of a fire hazard is very low since gas B is clean and does not contain hot particles from hot gasses N generated by the combustion chamber 155 because they are 100% exhausted to the atmosphere.

The heated gas "T" which is heated air mixed with recycled gas D, having passed through the heat exchanger 255, is directed by one or more fans 35 into the filter 205 to be cleaned. A plenum 275 may be located at the top of the heat exchanger 255 to receive the exhaust gasses J and, through one or more fans 55, to direct them to the atmosphere as gas N.

In FIGS. 1A, 1B, 2A and 2B, the fraction I of gasses H at a drying temperature is used to refrigerate the heat exchange chamber 245 and is recycled back to the system in a closed loop by one or more fans 35. The amount of gas H which becomes gas I is determined based on the amount and temperature of recycled gas D and gas J, in order to obtain gas at the desired drying temperature. Alternately, as shown in FIG. 3, one hundred percent of gas I may be directed to the heat exchanger chamber 245 to obtain gas H at the desired drying temperature.

A heat exchanger 255 may be used when the moist charge C cannot tolerate contamination by hot gasses that carry hot or unburned particles, or ashes or other particles that may affect the taste, smell or other characteristics of dried material C. In general, food products such as grains or tea, for example, fall into this category of materials. The use of a commercial heat exchanger is an expensive but effective solution to avoid above-mentioned problems since all of the dirty and hot combustion gasses N are exhausted to the atmosphere. However, heating efficiency may be reduced, as shown, for example in Table 1, since combustion chamber gasses do not become part of the drying gasses and the desired drying temperature is attained only through air heated by the heat exchanger 255. In addition, drying efficiency is reduced because the drying temperature may have to be reduced due to an increased risk of a fire occurrence as the atmosphere inside the drying chamber 105 is rich in oxygen and free from carbon dioxide.

The mixing chamber 165 provides a last opportunity for gasses at a drying temperature (cleaned gasses T or gasses H) to thoroughly mix and assure a homogenous drying temperature before entering the drying chamber 105. While not a requirement, the mixing chamber 165 may be large, about the same volume as the gas occupies in the drying chamber 105 when loaded with material. The large size of the mixing chamber 165 dampens any sudden variations in temperature of the incoming gases and helps maintain an almost constant temperature of the gases going into the drying chamber 105.

As shown in FIG. 2B, the mixing chamber 165 may surround the drying chamber 105. Alternately, as shown in FIGS. 1A, 1B, 2A, 3, 5A and 5B, the mixing chamber 165 may be disposed adjacent to the drying chamber 105.

One or more fans 35 may be disposed at an upper portion of the rectangular shell 305, as shown in FIG. 4, to direct the clean, hot drying gasses B from the mixing chamber 165 into the drying chamber 105. The drying gasses B may be directed through the periphery of the angle of repose of the dried material C and into the drying chamber 105 as shown in FIG. 2B.

The chimney/exhaust 185 receives exhaust gasses F from the drying chamber 105. The exhaust gas F from the drying chamber 105 may be at a cooled temperature of about 80° C. (about 176° F.). According to an exemplary aspect, the chimney/exhaust 185 may also receive exhaust gas N from the combustion chamber.

A chimney/exhaust 185 may also include another filter (not shown) to remove solid particles from exhaust gasses M before they are vented to the atmosphere.

Fans and plenums may be located throughout the drying apparatus as described above. Further, not all the fans and plenums as described above may be used and additional fans and plenums may be used. An exit plenum 195, as shown in FIGS. 2B and 4, may surround the loading chute 115 and receive the humid and dirty gasses from the dryer 105. These gasses may be at a temperature of about 80° C. (about 176° F.). An exhaust fan 45 may be disposed at the chimney/exhaust 185 to draw gasses M out into the atmosphere. One or more fans 35 may be positioned between the exit plenum 195 of the drying chamber 105 and the water filter 205. The one or more fans 35 may carry humid gasses D from the dryer, recycled gas L from the heat exchange chamber 245, and recycled hot gasses J from the combustion chamber to the water filter 205.

A plurality of separate fans 35 (for example 4 fans) may be spaced equidistant from each other inside and around the plenum 195, to direct gasses B into the drying chamber 105 after passing through the mixing chamber 165. These fans may also force the gasses D from the plenum 195 through one or more filters 205 before entering the mixing chamber 165 on their way to the drying chamber 105 and making contact with the charge material.

The fans may each be operated by a separate motor, or certain fans, for example four fans may share a motor. Fan velocity may be controlled via electronic instruments and frequency regulators that interact with pressure gauges to maintain a desired pressure inside the drying chamber 105. As an alternative to a plurality of fans 35, a single centrifugal fan may be used as fan 35 to direct gasses B from the mixing chamber 165 to the drying chamber 105. A single centrifugal fan 35, operating for example at a maximum capacity (e.g. 14,000 cubic meters per hour, 100 mm water column, operating temperature <180° C.), may create a depression inside the drying chamber 105 to draw gasses from the mixing chamber 165 into the drying chamber 105.

An exhaust fan 45 (e.g. 3600 cubic meters per hour, 40 mm water column, operating temperature <120° C.) may be disposed at the chimney/exhaust 185 to take gasses F from the drying chamber 105, as well as any other exhaust gasses, and vent them to the atmosphere. Increasing a velocity of the exhaust fan 45, and/or of a main fan 35, increases a depression inside the drying chamber and helps the hot gasses B pass quickly through the material. This may generate a negative pressure on top of the rotating plate 125, which in turn, could create air infiltrations into the drying chamber. Decreasing a velocity of the exhaust fan 45 and/or the main fan 35 may lower the suction to a point that the exhaust fan 45 will not be capable of handling the amount of gasses directed thereto. In such a case, a pressure on top of the plate 125 will be slightly positive, and hot gasses from the fan or fans 35 may leak out of the drying chamber 105. The hood and chimney 285 draw these leaks into the charging chute 115 to avoid heat losses and possible contamination of the plant environment. In addition, this keeps oxygen from entering into the drying chamber 105, thus reducing a potential fire hazard within the drying chamber 105.

Various ductwork or the like may be used for transportation of gasses between various elements as would be understood by one of skill in the art. FIG. 2B illustrates an exemplary design in which ductwork is reduced to a minimum to increase the efficiency of the overall system.

The entire drying apparatus as described herein with respect to exemplary embodiments may be constructed of materials and elements which can be easily disassembled and transported by truck. For example, bolted corrugated sheets, similar to those used in the construction of grain silos may be used for the drying chamber 105 and the preheating chamber 265.

Moisture content of material input in to an exemplary drying apparatus of the present invention may have a moisture content between about 30% and 50% and may be dried down to a moisture content of about 5-10% or less with an exemplary temperature range of about 140-150° C. provided the moist material A is allowed sufficient drying time inside the drying chamber 105 to reach desired moisture content of the dried material.

According to embodiments of the present invention, the material to be dried may remain within the apparatus for between about 8-12 hours or less. An increase in drying temperature reduces the necessary drying time, and a decrease in drying temperature increases the necessary drying time as would be understood by one of skill in the art.

The internal volume of a drying chamber, as discussed above with respect to various embodiments of the present invention, may be about 28 cubic meters, and may have a working volume of about 26 cubic meters. However, other volumes may be obtained depending on users' requirements and can be calculated as previously explained, and as would be understood by one of skill in the art.

As discussed above (FIGS. 1A, 1B, 2A AND 2B), according to exemplary embodiments of this invention, very little oxygen enters the drying chamber 105 when exhaust gasses J from the combustion chamber 155 are recycled into the system. The heated gas J which is output from the combustion chamber 155 is a byproduct of combustion and therefore includes very little oxygen. Further, as described above, air pressures at points throughout the circuit of gasses are maintained such that there is little to no infiltration of oxygen from ambient air into the circuit. Further, the oxygen-poor gasses output from the heat exchanger and drying chamber are recycled into the circuit through one or more fans 35. This lack of oxygen in the circuit of gasses enables the material to be dried at a very high temperature with little fire hazard. Thus, the material can be dried more quickly and efficiently.

However, an emergency water system or other fire alarm system as would be understood by one of skill in the art may be installed in and employed in conjunction with the various apparatuses as described above.

Exemplary flow sheets and operating data of the various equipment comprising an exemplary drying apparatus of the present invention are shown in Table 1 (below).

TABLE 1

Equipment and Production Data
Drying Apparatus with 26 cubic meters (918 cu.ft.) of Working Volume

| | | Units | FIG. 1 Basic | FIG. 1B w/Preheater | FIG. 2B w/Filter | FIG. 3 w/Filter + Heat.Exch. |
|---|---|---|---|---|---|---|
| **Drying Performance** | | | | | | |
| "A" Moist Material Charge | (kilos/hour) | kilos/hr | 4960 | 960 | 960 | 960 |
| | (pounds/hour) | lbs/hr | 2,116 | 2,116 | 2,116 | 2,116 |
| | (% moisture content) | % MC | 50% | 50% | 50% | 50% |
| "C" Dried Material | (kilos/hour) | kilos/hr | 600 | 600 | 600 | 600 |
| | (pounds/hour) | lbs/hr | 1,323 | 1,323 | 1,323 | 1,323 |
| | (% moisture content) | % MC | 20% | 20% | 20% | 20% |
| Evaporated Water | (kilos/hour) | kilos/hour | 360 | 404 | 360 | 360 |
| | (pounds/hour) | lbs/hour | 794 | 891 | 794 | 794 |
| Evporation Performance | (kilocalories/kilo of water) | kcal/kilo | 900 | 900 | 900 | 900 |
| | (BTU/pound of water) | BTU/lb | 1,620 | 1,620 | 1,620 | 1,620 |
| Average density of | (kilos/cubic meter) | kilos/m3 | 311 | 311 | 311 | 311 |
| Material | (pounds/cubic foot) | lbs/cu.ft | 19 | 19 | 19 | 19 |
| Furnace volume | (cubic meters) | m3 | 26 | 26 | 26 | 26 |
| | (cubic feet) | cu.ft. | 918 | 918 | 918 | 918 |
| Drying Temperature | | ° C. | 150 | 150 | 150 | 150 |
| | | ° F. | 302 | 302 | 302 | 302 |
| Residence Time | | hours | 8.4 | 8.4 | 8.4 | 8.4 |
| | | | FIG. 1A Basic | | | |
| **Centrifugal Fans ("35")** | | | | | | |
| Quantity | | | 4 | 4 | 4 | 4 |
| Volume Flow/Fan | (cubic meters per hour) | m3/hr | 5,256 | 5,256 | 5,256 | 5,000 |
| | (cubic feet per minute) | cfm | 3,093 | 3,093 | 3,093 | 2,943 |
| Static pressure drop | (millimeters of water column) | mm · wc | 36 | 36 | 126 | 176 |
| | (inches of water column) | inches · wc | 1.43 | 1.43 | 4.98 | 6.94 |
| Maximum Working Temperature | | ° C. | 200 | 200 | 200 | 200 |
| | | ° F. | 392 | 392 | 392 | 392 |
| **Exhaust Fan ("45") - Drying Chamber** | | | | | | |
| Volume Flow | (cubic meters/hour) | m3/hr | 5,000 | 5,000 | 5,000 | 5,000 |
| | (cubic feet per minute) | cfm | 2,943 | 2,943 | 2,943 | 2,943 |
| Static pressure drop | (millimeters of water column) | mm · wc | 37 | 37 | 37 | 37 |
| | (inches of water column) | inches · wc | 1.46 | 1.46 | 1.46 | 1.46 |
| Maximum Working Temperature | | ° C. | 120 | 120 | 120 | 120 |
| | | ° F. | 248 | 248 | 248 | 248 |
| % Recirculation | | % | 90% | 90% | 90% | 90% |
| **Exhaust Fan ("55") - Combustion Chamber** | | | | | | |
| Mass Flow | (kilos/hour) | kilos/hr | | | | 2,086 |
| | (pounds per hour) | lbs/hr | | | | 4,598 |
| Gas Density | (kilos/cubic meter) | kilos/m3 | | | | 0.71 |
| | (pounds per cubic foot) | lbs/cu.ft | | | | 0.044 |
| Volume Flow | (cubic meters/hour) | m3/hr | | | | 2,952 |
| | (cubic feet/hour) | cfm | | | | 1,737 |
| Static pressure drop | (millimeters of water column) | mm · wc | | | | 40 |
| | (inches of water column) | inches · wc | | | | 1.57 |
| Maximum Working Temperature | | ° C. | | | | 250 |
| | | ° F. | | | | 482 |

TABLE 1-continued

| Equipment and Production Data<br>Drying Apparatus with 26 cubic meters (918 cu.ft.) of Working Volume | | | Units | | FIG. 1B w/Preheater | FIG. 2B w/Filter | FIG. 3 w/Filter + Heat.Exch. |
|---|---|---|---|---|---|---|---|
| Combustion Chamber ("155") | | | | | | | |
| Firewood | % moisture content | | % | 30% | 30% | 30% | 30% |
| | lower heating value | (kilocalories/kilo) | kcal/kilo | 2,900 | 2,900 | 2,900 | 2,900 |
| | | (BTU/pound) | BTU/lb. | 5,220 | 5,220 | 5,220 | 5,220 |
| | consumption | | kilos/hr | 112 | 112 | 112 | 160 |
| | | | lbs/hr | 246 | 246 | 246 | 352 |
| | specific heat - firewood gas | | kcal/kilo. ° C. | 0.277 | 0.277 | 0.277 | 0.277 |
| | specific heat - firewood | | kcal/kilo. ° C. | 0.500 | 0.500 | 0.500 | 0.500 |
| Gas generated | (kilos/hour) | | kilos/hr | 894 | 894 | 894 | 1,277 |
| | (pounds/hour) | | lbs/hr | 1,970 | 1,970 | 1,970 | 2,815 |
| Static pressure drop | (millimeters of water column) | | mm · wc | −10.0 | −10 | −10.0 | −10.0 |
| | (inches of water column) | | inches · wc | −0.39 | −0.39 | −0.39 | −0.39 |
| Maximum Working Temperature | | | ° C. | 1,500 | 1,500 | 1,500 | 1,500 |
| | | | ° F. | 2,732 | 2,732 | 2,732 | 2,732 |
| Pre-Heater ("265") | | | | | | | |
| Exhaust temperature | | | ° C. | | 80 | | |
| | | | ° F. | | 176 | | |
| Latent heat of water vapor | | | kcal/kilo | | 600 | | |
| | | | BTU/lb | | 080 | | |
| Firewood - Moist Material Charge | | | kilos/hr | | 960 | | |
| | | | lbs/hr | | 2,116 | | |
| Firewood temperature in Preheating Chamber (Storage bin) | | | ° C. | | 25 | | |
| | | | ° F. | | 77 | | |
| Maximum energy recuperated | | | kcal/hr | | 26,400 | | |
| | | | BTU/hr | | 104,760 | | |
| Evaporated water in Preheating Chamber (Storage bin) | | | kilos/hr | | 44 | | |
| | | | lbs/hr | | 970 | | |
| Filter ("205") - Dry Cyclone | | | | | | | |
| Volume Flow | (cubic meters/hour) | | m3/hr | | | 21,023 | 20,000 |
| | (cubic feet/hour) | | cfm | | | 12,374 | 11,772 |
| Static pressure drop | (millimeters of water column) | | mm · wc | | | 90 | 90 |
| | (inches of water column) | | inches wc | | | 3.54 | 3.54 |
| Maximum Working Temperature | | | ° C. | | | 250 | 250 |
| | | | ° F. | | | 482 | 482 |
| Efficiency (particles over 0.0045 mm, 0.000177 inches) | | | % | | | 99.0% | 99.0% |
| Heat Exchanger Chamber ("245") | | | | | | | |
| Maximum Hot Gas Mass Flow from Combustion Chamber | | | kilos/hr | 894 | 894 | 894 | 1,277 |
| | | | lbs./hr | 1,970 | 1,970 | 1,970 | 2,814 |
| Gas Density at 150° C. | (kilos/cubic meter) | | kilos/m3 | 0.87 | 0.87 | 0.87 | 0.87 |
| Gas Density at 302° F. | (pounds/cubic foot) | | lbs/cu.ft | 0.0545 | 0.0545 | 0.0545 | 0.0545 |
| Maximum Hot Gas Volume Flow from | | | m3/hr | 1,023 | 1.023 | 1,023 | 20,000 |
| Combustion Chamber | | | cfm/hr | 602 | 602 | 602 | 11,772 |
| Static pressure drop - Hot Gas at 1500° C. max. | | | mm · wc | 20 | 20 | 20 | 20 |
| | | | inches · wc | 0.79 | 0.79 | 0.79 | 0.79 |
| Static pressure drop - Gas at 150° C. | | | mm · wc | 20 | 20 | 20 | 70 |
| | | | inches · wc | 0.79 | 0.79 | 0.79 | 2.76 |
| Maximum Inlet Temperature - Hot Gas from | | | ° C. | 1,500 | 1,500 | 1,500 | 1,500 |
| Combustion Chamber | | | ° F. | 2,732 | 2,732 | 2,732 | 2,732 |
| Maximum Outlet Temperature - Hot Gas to Chimney | | | ° C. | 250 | 250 | 250 | 250 |
| | | | ° F. | 482 | 482 | 482 | 482 |
| Efficiency of Heat Transfer | | | % | 100% | 100% | 100% | 70% |
| Inlet Temperature | | | ° C. | 150 | 150 | 150 | 80 |
| | | | ° F. | 302 | 302 | 302 | 176 |
| Maximum Outlet Temperature | | | ° C. | 840 | 840 | 840 | 150 |
| | | | ° F. | 1,544 | 1,544 | 1,544 | 302 |

Applicants note that the dimensions (including the various dimensions of the extractor), quantities (including solid charge of materials and gases), temperatures, and pressures described herein, are merely exemplary and that the present invention may be practiced with various dimensions, quantities, temperatures, and pressures and is limited only as specifically recited in the claims.

While the present invention has been particularly shown and described with reference to exemplary embodiments thereof, it will be understood by those of ordinary skill in the art that various changes in form and details may be made therein without departing from the spirit and scope of the present invention as defined by the following claims. The exemplary embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A continuous drying apparatus, comprising:

a drying chamber, a filter, a combustion chamber, a heat exchange chamber, a mixing chamber, and a chimney, wherein:

the drying chamber comprises an opening through which biomass is loadable and an extractor which extracts biomass therefrom;

the drying chamber receives gas at a drying temperature from the mixing chamber and outputs recycled gas, which is directed to the filter, and exhaust gas;

the filter filters the recycled gas from the drying chamber, the heat exchange chamber and the combustion chamber and outputs filtered gas to the drying chamber;

the combustion chamber heats gas and outputs heated gas to the heat exchange chamber;

the heat exchange chamber enables an exchange of heat between filtered gas from the filter and heated gas from the combustion chamber and outputs gas to the mixing chamber;

the mixing chamber comprises at least one fan which directs the gas at a drying temperature into the drying chamber.

2. The continuous drying apparatus according to claim 1, wherein the gas output from the filter is a drying temperature, and the gas output from the combustion chamber is at a temperature above the drying temperature.

3. The continuous drying apparatus according to claim 1, wherein the opening through which the biomass is loadable comprises a chute, disposed at an upper end of the drying chamber.

4. The continuous drying apparatus according to claim 3, wherein biomass loaded through the chute descends through the drying chamber by gravity.

5. The continuous drying apparatus according to claim 1, wherein the biomass loaded into the drying chamber is heated within the drying chamber by the received gas at the drying temperature by convection heating.

6. The continuous drying apparatus according to claim 3, further comprising at least one fan which directs gas from the mixing chamber into a lower end of the drying chamber such that gas from the mixing chamber rises within the drying chamber in a direction against a descending direction of biomass from the chute.

7. The continuous drying apparatus according to claim 1, wherein the extractor comprises a rotating plate forming a lower surface of the drying chamber and at least one arm which rotates in a plane above and substantially parallel to the rotating plate, such that a rotation of the at least one arm sweeps biomass off a periphery of the rotating plate and out of the drying chamber through an exit opening in a lateral wall of the drying chamber.

8. The continuous drying apparatus according to claim 1, wherein the drying apparatus is a vertical continuous dryer.

* * * * *